US006404117B1

(12) United States Patent
Soneda et al.

(10) Patent No.: US 6,404,117 B1
(45) Date of Patent: Jun. 11, 2002

(54) CATHODE-RAY TUBE DEVICE COMPRISING A DEFLECTION YOKE WITH A NON-CIRCULAR CORE HAVING SPECIFIED DIMENSIONAL RELATIONSHIPS

(75) Inventors: Kouichi Soneda, Kumagaya; Yuuichi Sano; Masahiro Yokota, both of Fukaya, all of (JP)

(73) Assignee: Kabushiki Kaisha Toshiba, Kenagawa-Ken (JP)

( * ) Notice: Subject to any disclaimer, the term of this patent is extended or adjusted under 35 U.S.C. 154(b) by 0 days.

(21) Appl. No.: 09/423,828

(22) PCT Filed: Mar. 15, 1999

(86) PCT No.: PCT/JP99/01251

§ 371 (c)(1),
(2), (4) Date: Nov. 6, 1999

(87) PCT Pub. No.: WO99/48127

PCT Pub. Date: Sep. 23, 1999

(30) Foreign Application Priority Data

Mar. 16, 1998 (JP) ..... 10-065737

(51) Int. Cl.[7] ..... H01J 29/70; H01J 31/00
(52) U.S. Cl. ..... 313/440; 313/477 R
(58) Field of Search ..... 313/440, 461, 313/477 R; 220/21 A, 21 R

(56) References Cited

U.S. PATENT DOCUMENTS

| | | | | |
|---|---|---|---|---|
| 3,731,129 A | | 5/1973 | Tsuneta et al. | 313/64 |
| 5,763,995 A | | 6/1998 | Sano et al. | 313/477 |
| 5,801,481 A | | 9/1998 | Yokota | 313/440 |
| 5,929,559 A | | 7/1999 | Sano et al. | 313/477 |
| 5,962,964 A | * | 10/1999 | Sano et al. | 313/477 R |
| 6,002,203 A | * | 12/1999 | Yokota et al. | 313/477 R |

FOREIGN PATENT DOCUMENTS

| | | |
|---|---|---|
| JP | 48-34349 | 10/1973 |
| JP | 48-85030 | 11/1973 |
| JP | 50-60917 | 6/1975 |
| JP | 2-123646 | 5/1990 |
| JP | 2-297842 | 12/1990 |
| JP | 8-7781 | 1/1996 |
| JP | 9-293468 | 11/1997 |
| JP | 9-320492 | 12/1997 |
| JP | 10-149785 | 6/1998 |
| JP | 11-16517 | 1/1999 |

* cited by examiner

*Primary Examiner*—Vip Patel
*Assistant Examiner*—Mack Haynes
(74) *Attorney, Agent, or Firm*—Pillsbury Winthrop LLP

(57) ABSTRACT

A section perpendicular to a tube axis, of a yoke portion having a deflection yoke mounted thereon is in the shape of a non-circle based on a rectangle. A section perpendicular to the tube axis, of a core portion of the deflection yoke has a shape holding the relation $$(M+N)/(2*(M^2+N^2)^{1/2}<(SB+LB)/(2DB)\leq 0.90$$

where M:N is an aspect ratio, SB is the inner diameter along the vertical axis, LB the inner diameter along the horizontal axis, and DB a maximum inner diameter.

6 Claims, 5 Drawing Sheets

CATHODE-RAY TUBE DEVICE COMPRISING A DEFLECTION YOKE WITH A NON-CIRCULAR CORE HAVING SPECIFIED DIMENSIONAL RELATIONSHIPS

TECHNICAL FIELD

The present invention relates to a cathode ray tube apparatus, or more in particular, to a cathode ray tube apparatus comprising a deflection yoke capable of reducing the deflection power and the leakage magnetic field effectively and a vacuum envelope capable of securing a sufficient environmental pressure resistance.

BACKGROUND ART

Generally, the cathode ray tube apparatus comprises a vacuum envelope made of glass and a deflection yoke forming a deflection magnetic field for deflecting electron beams. The vacuum envelope includes a rectangular faceplate, a cylindrical neck portion and a funnel portion for coupling the faceplate and the neck portion to each other. The deflection yoke is mounted over the portion extending from the neck portion to a yoke portion in the funnel portion.

In the cathode ray tube apparatus having this construction, the deflection power supplied to the deflection yoke is the main power consumed in the apparatus. In recent years, in order to satisfy the requirement for high brightness and high definition of the cathode ray tube apparatus, the trend is toward an even more increased deflection power. For the power consumption of the cathode ray tube apparatus to be reduced, however, the deflection power is required to be decreased. Also, with this cathode ray tube apparatus, it is necessary to reduce the leakage magnetic field from the deflection yoke out of the cathode ray tube apparatus.

Generally, for reducing the deflection power and the leakage magnetic field, the outer diameters of the neck portion and the yoke portion are desirably reduced. With this structure, the operating space of the deflection magnetic field is reduced and the operating efficiency of the deflection magnetic field exerted on the electron beams is improved.

In the conventional cathode ray tube apparatus, however, the electron beams pass in proximity to the inner surface of the yoke portion. If the outer diameters of the neck portion and the yoke portion are reduced, therefore, the electron beam having a large deflection angle, that is, having an electron beam trajectory at a large angle to the tube axis impinges on the inner wall of the yoke portion. Such an electron beam fails to impinge on the phosphor screen and causes a display failure. In the cathode ray tube apparatus having this construction, it is difficult to reduce the deflection power and the leakage magnetic field by reducing the outer diameters of the neck portion and the yoke portion.

U.S. Pat. No. 3,731,129 discloses a cathode ray tube in which the yoke portion has the shape of a section perpendicular to the tube axis changing progressively from a circle to a rectangle starting with the neck portion toward the faceplate. With this pyramidal yoke portion, the electron beam can be prevented from impinging on the inner wall of the yoke portion even in the case where the outer diameters of the neck portion and the yoke portion are reduced. Also, with this structure, the deflection magnetic field acts on the electron beam with a comparatively high efficiency.

In the cathode ray tube apparatus of this configuration, however, the side surfaces of the yoke portion flatten more and the environmental pressure resistance of the yoke portion of the envelope is reduced more, the higher the rectangularity of the yoke portion. Thus the safety is adversely affected.

Recently, a flat display unit with a flat outer surface of the faceplate has found an application. In the flat display unit with an outer surface having a radius of curvature at least twice the effective diagonal length of the phosphor screen (the faceplate is completely flat when the radius of curvature is infinitely large), however, the environmental pressure resistance of the faceplate is low. Additionally, the yoke portion, if pyramidal, decreases also in the environmental pressure resistance, thereby making it difficult to secure a mechanical strength required of the vacuum envelope as a whole for safety. The strength of the vacuum envelope, that is, the environmental pressure resistance and the mechanical strength thereof combined will hereinafter be collectively called the bulb strength.

The two requirements described above, that is, a rectangular section of the yoke portion in order to sufficiently reduce the deflection power and the leakage magnetic field on the one hand and a sufficient bulb strength even with a rectangular section of the yoke portion on the other, cannot be met at the same time by the conventional cathode ray tube apparatus. It is especially difficult for the cathode ray tube apparatus with a flat display unit to reduce the deflection power and the leakage magnetic field and a sufficient bulb strength at the same time.

DISCLOSURE OF INVENTION

The present invention has been developed to solve the above-mentioned problem and the object thereof is to provide a cathode ray tube apparatus in which a sufficient bulb strength can be secured even in the case where the yoke portion of the vacuum envelope is substantially pyramidal, and in which the requirement for high brightness and high definition can be met even after the deflection power and the leakage magnetic field are reduced.

According to the present invention, there is provided a cathode ray tube apparatus comprising:

a vacuum envelope including a faceplate having on the inner surface thereof a substantially rectangular phosphor screen having an aspect ratio M:N between the length along a horizontal axis perpendicular to a tube axis and the length along a vertical axis perpendicular to the tube axis and the horizontal axis, a cylindrical neck portion having an electron gun assembly built therein for emitting electron beams in the direction along the tube axis, a funnel portion for connecting the faceplate and the neck portion, and a yoke portion of which a section perpendicular to the tube axis on the neck portion side of the funnel portion changes in shape from a circle of the same diameter as the neck portion to a non-circle having a maximum diameter in other than the directions along the horizontal axis and the vertical axis; and a deflection yoke mounted on the outer surface of the vacuum envelope and extending from the neck portion to the yoke portion for forming a deflection magnetic field for deflecting the electron beams;

wherein the deflection yoke includes a cylindrical core portion formed of a magnetic material surrounding at least one of a horizontal deflection coil and a vertical deflection coil for forming the deflection magnetic field; and wherein at least one of the sections of the core portion perpendicular to the tube axis is a non-circle having a maximum inner diameter in other than the directions along the vertical axis and the horizontal axis, where the inner diameter is the distance between the tube axis and the inner surface of the core portion, and holds the relation $$(M+N)/(2*(M^2+N^2)^{1/2}<(SB+LB)/(2DB)\leqq 0.90$$

where SB is the inner diameter along the vertical axis, LB the inner diameter along the horizontal axis, and DB the maximum inner diameter.

BEST MODE OF CARRYING OUT THE INVENTION

A cathode ray tube apparatus according to an embodiment of the present invention will be described in detail below with reference to the drawings.

The invention provides a cathode ray tube apparatus comprising a vacuum envelope including a yoke portion having an optimum shape capable of reducing the deflection power and securing a sufficient bulb strength at the same time, and a deflection yoke of an optimum shape mounted on the yoke portion, when the yoke portion of the vacuum envelope is formed in a substantially pyramidal shape.

Figure 1:
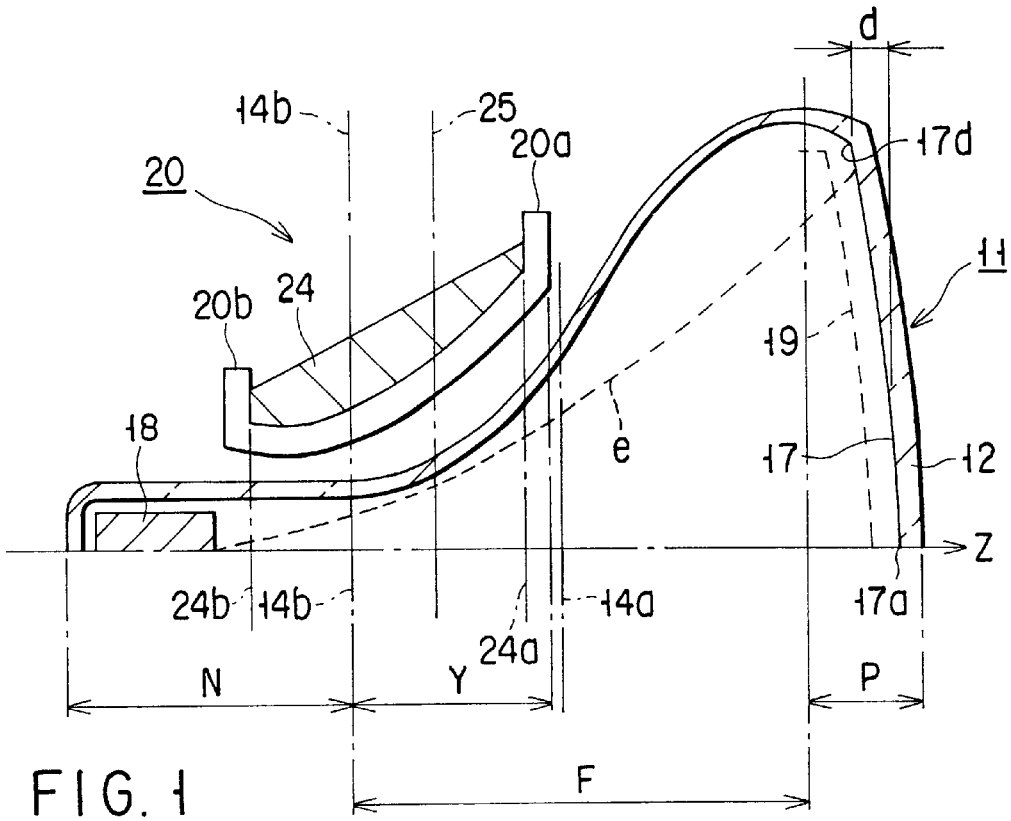
FIG. 1 is a sectional view schematically showing a configuration of a cathode ray tube apparatus according to the invention.
Figure 2:
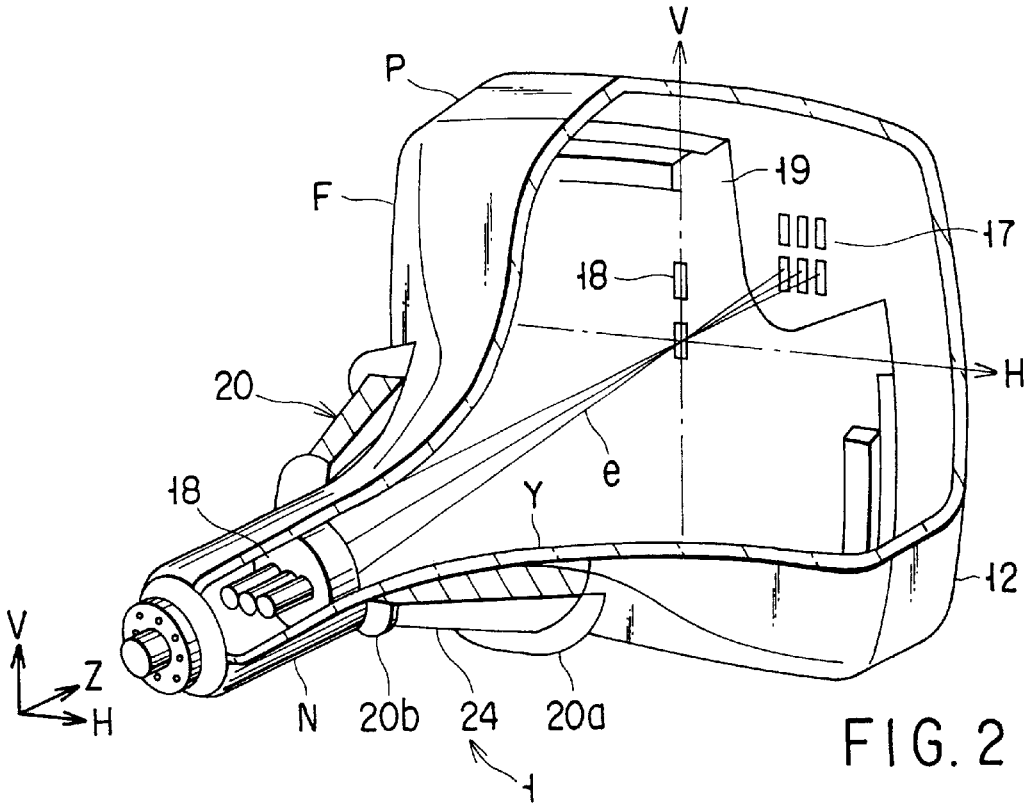
FIG. 2 is a partial sectional view schematically showing an outer appearance and an internal structure of the cathode ray tube apparatus of FIG. 1.

As shown in FIGS. 1 and 2, a cathode ray tube apparatus 1 comprises a vacuum envelope 11 made of glass and a deflection yoke 20 forming a deflection magnetic field for deflecting the electron beam. The vacuum envelope 11 includes a faceplate P having a substantially rectangular effective faceplate surface 12, a cylindrical neck portion N having a center axis coincident with the tube axis Z and a funnel portion F for coupling the faceplate P and the neck portion N to each other. The funnel portion F includes, on the neck portion side thereof, a yoke portion Y having the deflection yoke 20 mounted thereon.

The faceplate P includes on the inner surface thereof a phosphor screen 17 having striped or dotted three-color phosphor layers for emitting red, green and blue light, respectively. In this case, the flatness of the faceplate P is defined by the radius of curvature of the outline of the faceplate P approximated to a circle. Specifically, the radius of curvature of the faceplate P is determined by approximation of a circle based on a head d toward the neck portion N along the tube axis Z at a diagonal end 17*d* between the center 17*a* of the phosphor screen and the diagonal end 17*d*. According to this embodiment, the flatness in terms of radius of curvature of the faceplate P is more than twice the effective diagonal length of the effective faceplate 12. In the case where the radius of curvature is infinitely large, it indicates that the outer surface of the faceplate P is completely flat. In other words, this invention is applicable to what is called the flat display unit having a faceplate P having a substantially flat outer surface.

The faceplate P includes a shadow mask 19 arranged in spaced and opposed relation to the phosphor screen 17. This shadow mask 19 has on the inner side thereof a multiplicity of apertures 18 for passing the electron beams.

The neck portion N includes therein an electron gun assembly 18 for emitting three electron beams e aligned and passing in the same horizontal plane, that is, what is called the in-line electron gun assembly. The three electron beams e are aligned along the horizontal axis H and emitted along the direction parallel to the tube axis Z. Of the three electron beams, the electron beam constituting the center beam proceeds along the trajectory nearest to the center axis of the neck portion N. The electron beams constituting a pair of side beams proceed along the trajectories on the both sides of the center beam.

The electron gun assembly 18 converges the three electron beams e toward the phosphor screen 17 while at the same time focusing each of the three electron beams e on the phosphor screen 17.

Figure 3:
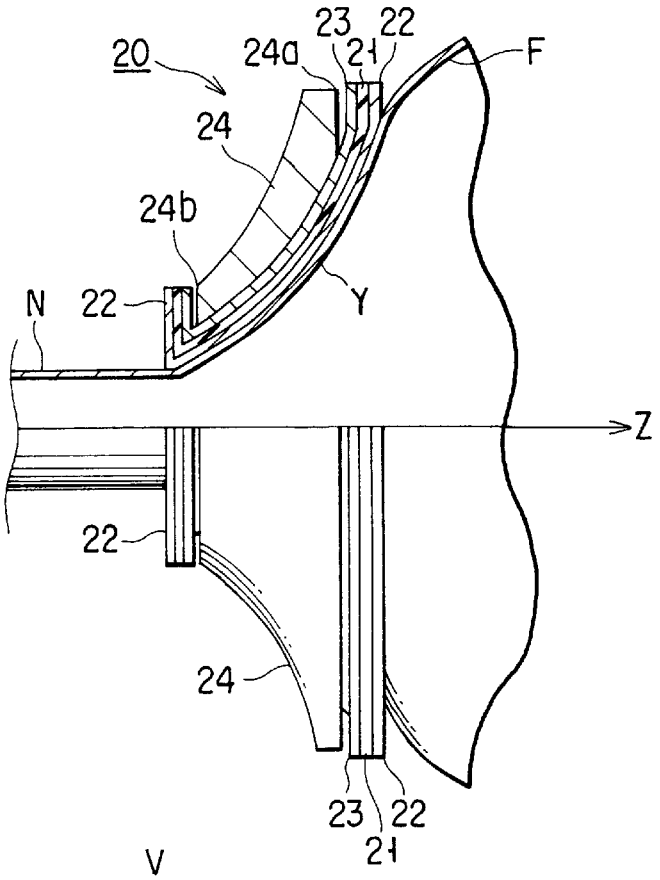
FIG. 3 is a partial sectional view schematically showing an outer appearance and an internal structure of the deflection yoke used with the cathode ray tube apparatus of FIG. 1.

The deflection yoke 20, as shown in FIG. 3, includes a horizontal deflection coil 22 for forming a horizontal deflection magnetic field in pin-cushion form, a vertical deflection coil 23 for forming a vertical deflection magnetic field in barrel form, a cylindrical separator 21 interposed between the horizontal deflection coil 22 and the vertical deflection coil 23, and a cylindrical core portion 24 of high permeability. The deflection yoke 20 forms a non-uniform deflection magnetic field for deflecting the electron beam by the horizontal deflection coil 22 and the vertical deflection coil 23.

The separator 21 is formed of a synthetic resin in the shape of a horn having an aperture size on the neck portion N side thereof smaller than the aperture size on the faceplate P side thereof. The horizontal deflection coil 22 is of saddle type and fixed in grooves formed in the inner wall of the separator 21. The vertical deflection coil 23 is of saddle type and fixed in the outer wall of the separator 21. The magnetic field leaking from the deflection yoke 20 can be reduced by combining the saddle-type horizontal deflection coil 22 and the saddle-type vertical deflection coil 23 with each other. The core portion 24 is fixedly arranged around the outer periphery of the horizontal deflection coil 22 and the vertical deflection coil 23 and constitutes the magnetic core of the deflection magnetic field.

In the cathode ray tube apparatus having this structure, the three electron beams e emitted from the electron gun assembly 18 are deflected while being self-converged by the non-uniform deflection magnetic field generated by the deflection yoke 20. Specifically, the three electron beams e scan the phosphor screen 17 in the directions of the horizontal axis H and the vertical axis V, respectively, through the shadow mask 19. As a result, a color image is displayed.

As shown in FIG. 1, the outline of the funnel portion F along the tube axis Z is formed substantially in a S-shaped curve from the faceplate side to the neck portion side. Specifically, the funnel portion F is formed convex on the faceplate P side thereof, and concave on the neck portion N side of the yoke portion Y. The boundary 14*a* on the faceplate side of the yoke portion Y is the inflection point of the S-shaped curve. The boundary 14*b* on the neck portion N side of the yoke portion Y is a junction with the neck portion N. The deflection yoke 20 is mounted in such a position that the end portion 20*a* on the faceplate side thereof is located in the neighborhood of the boundary 14*a* and the end portion 20*b* on the neck portion side thereof is located at a position corresponding to the neck portion beyond the boundary 14*b*. A deflection reference point 25 is located in the range of the yoke portion Y.

Figure 5A:
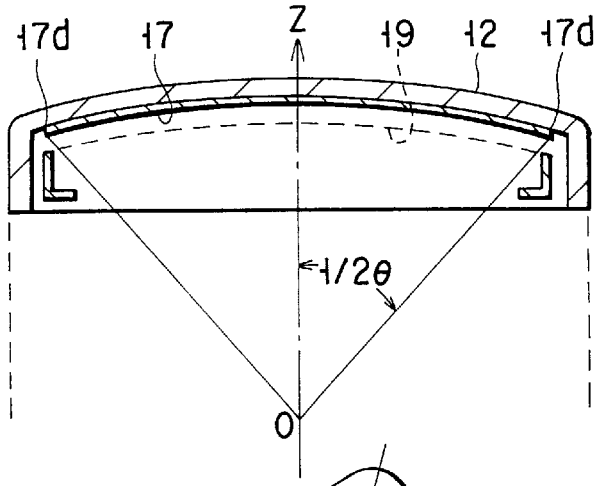
FIG. 5A is a sectional view of the faceplate of the cathode ray tube apparatus shown in FIG. 1, taken along a diagonal axis thereof.
Figure 5B:
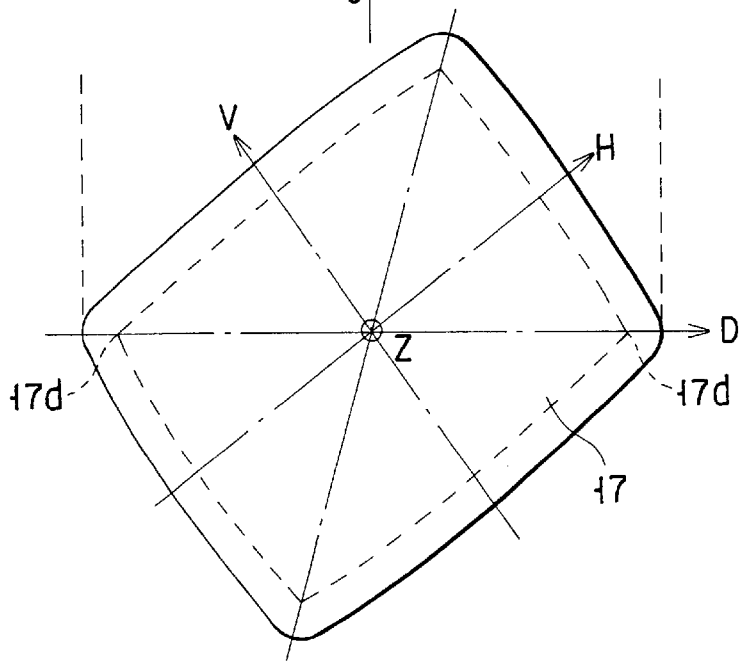
FIG. 5B is a plan view of the faceplate of the cathode ray tube apparatus of FIG. 1.

The deflection reference point 25 is defined as follows. As shown in FIGS. 5A and 5B, draw two lines connecting the ends 17*d* of the screen diagonals on both sides of the tube axis Z and a particular point 0 on the tube axis Z. The deflection reference point 25 is defined as the point 0 on the tube axis Z, when the angle between two lines corresponds to a maximum deflection angle θ according to the specification of the cathode ray tube apparatus. This deflection reference point 25 constitutes the deflection center about which the electron beam is deflected.

Figure 4:
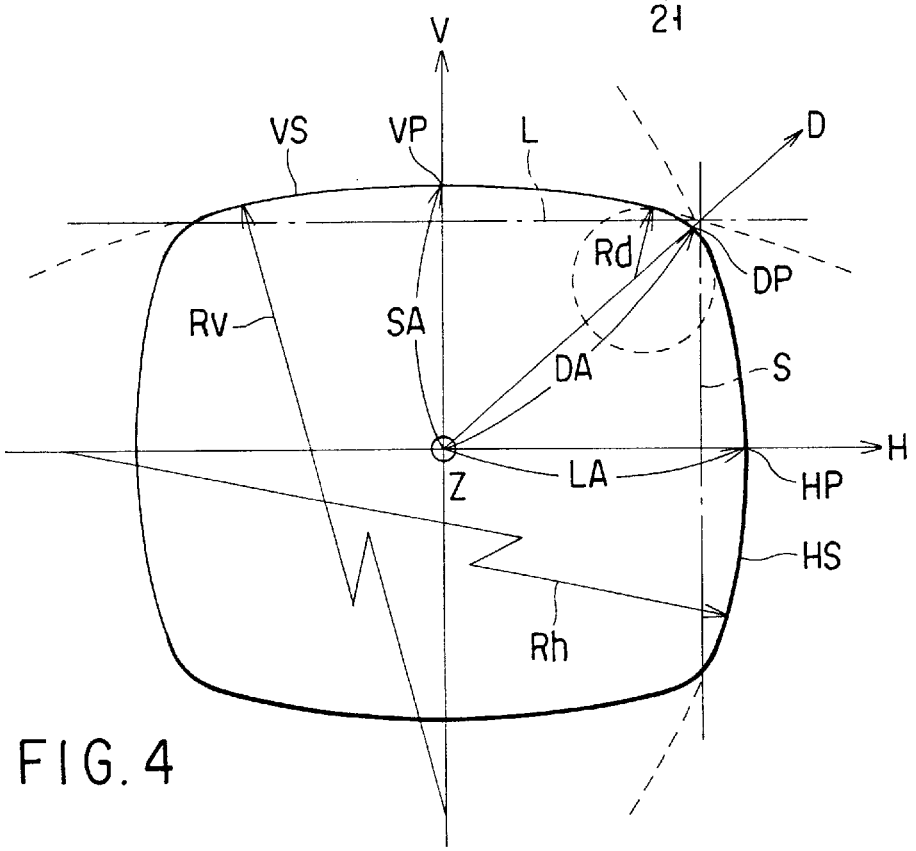
FIG. 4 is a sectional view schematically showing the outline of a section of the yoke portion of the cathode ray tube apparatus, taken in the direction perpendicular to the tube axis at a deflection reference point.

As shown in FIG. 4, the sectional shape of the outline of the yoke portion perpendicular to the tube axis at the deflection reference point 25 is not circular. Specifically, let HP an intersection between the horizontal axis H and the outline of the yoke portion, VP an intersection between the vertical axis V and the outline of the yoke portion, and DP an intersection between the diagonal axis D and the outline of the yoke portion. Also, let LA be the distance from the tube axis Z to the intersection HP, SA be the distance from the tube axis Z to the intersection VP, and DA be the distance from the tube axis Z to the intersection DP.

Then, the outline of the yoke portion is a non-circle in which an outer diameter other than the horizontal axis H and the vertical axis V assumes a maximum value. The sectional shape of the outline of the yoke portion shown in FIG. 4 is a substantial rectangle in which LA and SA are smaller than DA, and DA assumes the largest value.

In the cathode ray tube apparatus having the yoke portion of this shape, therefore, the deflection coils arranged in the neighborhood of the intersections HP and VP can be moved near to the electron beams, and therefore the operating efficiency of the deflection magnetic field exerted on the electron beams can be improved. As a result, the deflection power and the leakage magnetic field can be reduced.

In the example shown in FIG. 4, the diameter along the diagonal axis D is the largest of all. However, the diameter along the diagonal axis D is not necessary largest of all.

In the sectional shape of the outline of the yoke portion, the main surface outline VS crossing the vertical axis V is formed in an arc having a radius of curvature Rv having the center on the vertical axis V. The main surface outline HS crossing the horizontal axis H is formed in an arc having a radius of curvature Rh having the center on the horizontal axis H. The outline of the yoke portion in the neighborhood of the intersection DP is an arc having a radius of curvature Rd having the center on the diagonal axis D. The outline of the yoke portion is shaped by connecting these arcs. These surface outlines can alternatively be defined using other various formulae. In this way, the outline of the yoke portion is a non-circle which is never recessed toward the tube axis from the long side L and the short side S of the rectangle. In the example shown in FIG. 4, the yoke portion has an outline of a barrel-shaped section and is substantially formed in a pyramid.

The nearer to the rectangle is the section of the yoke portion shaped, the bulb strength of the vacuum envelope is deteriorated more, while the deflection power and the leakage magnetic field can be reduced more. An index of the rectangularity of the sectional shape is defined as $$X=(LA+SA)/(2DA)$$

In the case where the outline of the yoke portion is a cone having a circular section, LA and SA are equal to DA, and therefore the index X is 1. In the case where the outline of the yoke portion is a pyramid having a rectangular section, DA is the same as the cone-type for securing a margin between the outermost electron beam trajectory and the inner wall of the yoke portion. LA and SA, however, are smaller than for the cone-type. In other words, LA and SA are smaller than DA and therefore the index is smaller than 1.

In the case where the outline of the yoke portion is a perfect pyramid, let the aspect ratio of the rectangular section (ratio between the length along the horizontal axis and the length along the vertical axis) be M:N. Then, the index X is given as $$X=(M+N)/(2*(M^2+N^2)^{1/2})$$

This index X is the result of reducing the outer diameters in horizontal and vertical directions for converting the outline of the yoke portion into a rectangle. Nevertheless, the simulation analysis shows that the deflection power can be reduced in substantially similar fashion also when the outline of the yoke portion is rectangular only in the horizontal or vertical direction. Therefore, emphasis on LA or SA alone is not required.

Analysis was also made as to a point on the tube axis from which the outline of the yoke portion starts to be rectangular to assure a maximum effect. As a result, it was discovered that it is crucial to form a rectangle of the portion extending from the deflection reference point 25 to the end portion 20*a* on the screen side of the deflection yoke 20.

FIG. 1 shows an example trajectory of an electron beam e deflected toward the diagonal end 17*d* of the phosphor screen 17 by the deflection magnetic field. As the center of the deflection magnetic field approaches the neck portion from the deflection reference point 25, the deflection magnetic field on the neck portion side is strengthened, so that the electron beam e is deflected more on the neck portion side. As a result, the electron beam e deflected toward the diagonal end 17*d* impinges on the inner wall of the yoke portion. In the case where the center of the deflection magnetic field is nearer to the screen as seen from the deflection reference point 25, in contrast, the margin increases between the electron beam e and the inner wall of the yoke portion. Consequently, the end portion 20*b* of the deflection yoke 20 on the neck portion side thereof can be extended and thus the deflection power can be further reduced.

Also with a cathode ray tube apparatus having an outer diameter different from that of the neck portion described above, the shape of the yoke portion, though different generally up to the deflection reference point 25, is substantially the same on the screen side from the deflection reference point 25. Therefore, analysis may generally reaches the same result.

Now, an explanation will be given of the reduction in deflection power.

Figure 6:
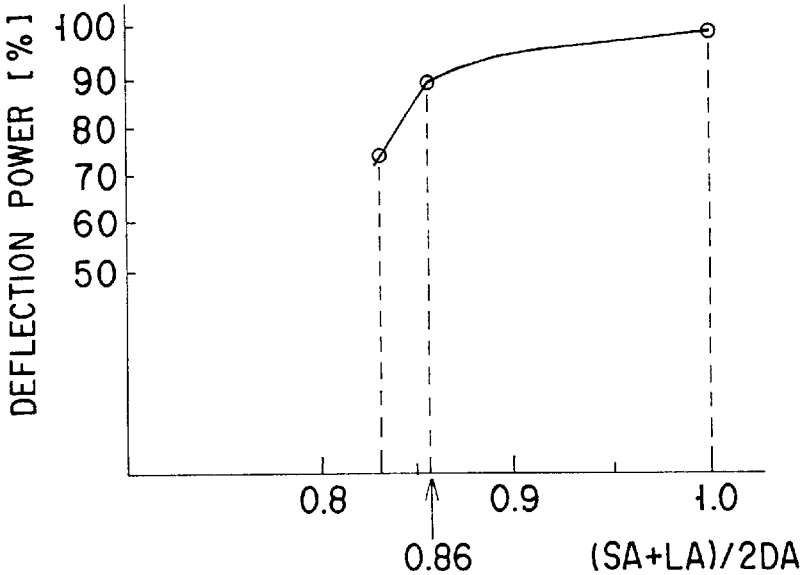
FIG. 6 is a diagram showing the relation between the rectangularity of the yoke portion of the cathode ray tube apparatus and the deflection power.

FIG. 6 shows the result of simulation of the deflection power with respect to the rectangularity index X of a section perpendicular to the tube axis at the deflection reference point 25.

This simulation assumes that the specification of the deflection yoke is same and that the deflection coils 22, 23 and the core portion 24 approach the electron beam by an amount the rectangularity of the yoke portion increases. The deflection power is the horizontal one supplied to the horizontal deflection coil 22. The deflection power for deflecting the electron beam e at a predetermined deflection rate in a cathode ray tube apparatus having the index X of 1 is assumed to be 100%.

As shown in FIG. 6, when the index X decreases from 0.86 approximately, the deflection power begins to suddenly decrease. Specifically, in the case where the electron beam e is deflected at a predetermined deflection rate, the deflection power can be reduced by about 10 to 30% as compared with a conical yoke portion (X=1). For the index X of 0.86 or more, in contrast, the deflection power cannot be reduced by more than 10%.

To summarize, by making the yoke portion of the vacuum envelope of a substantial pyramid of meeting the following conditions, the deflection power can be reduced while at the same time securing the bulb strength. Specifically, assuming that when the aspect ratio of a substantially rectangular phosphor screen is M:N, the aspect ratio of the rectangular section of the pyramidal yoke portion substantially coincides with the aspect ratio of the phosphor screen, the aspect ratio of the yoke portion section is regarded as M:N. Also, a section perpendicular to the tube axis at the deflection reference point 25 is assumed to have a shape satisfying the relation $$(M+N)/(2*(M^2+N^2)^{1/2}<(SA+LA)/(2DA)\leqq 0.86$$

where SA is the outer diameter of the yoke portion along the vertical axis, LA is the outer diameter of the yoke portion along the horizontal axis, and DA is the maximum outer diameter of the yoke portion.

Also, as shown in FIG. 4, the outline of the yoke portion having a section perpendicular to the tube axis at the deflection reference point 25 is a substantial rectangle not protruded toward the tube axis Z. The outline of this rectangle can be approximated by an arc having a radius of curvature Rv with the center on the vertical axis, an arc having a radius of curvature Rh with the center on the horizontal axis and an arc having a radius of curvature Rd with the center on the straight line connecting a point associated with the maximum outer diameter and the tube axis. At the same time, the sectional shape of the yoke portion is configured to assure Rh or Rv of 900 mm or less. Thus, a sufficient bulb strength can be secured.

The above-mentioned fact is applicable also to the case where the aspect ratio of the phosphor screen is 4:3, 16:9 or 3:4.

Also, in order to further reduce the deflection power, the rectangularity index X of the core portion 24 of the deflection yoke 20 is determined the following manner, taking the sectional area of the coil wire constituting the deflection coils into consideration.

Figure 7:
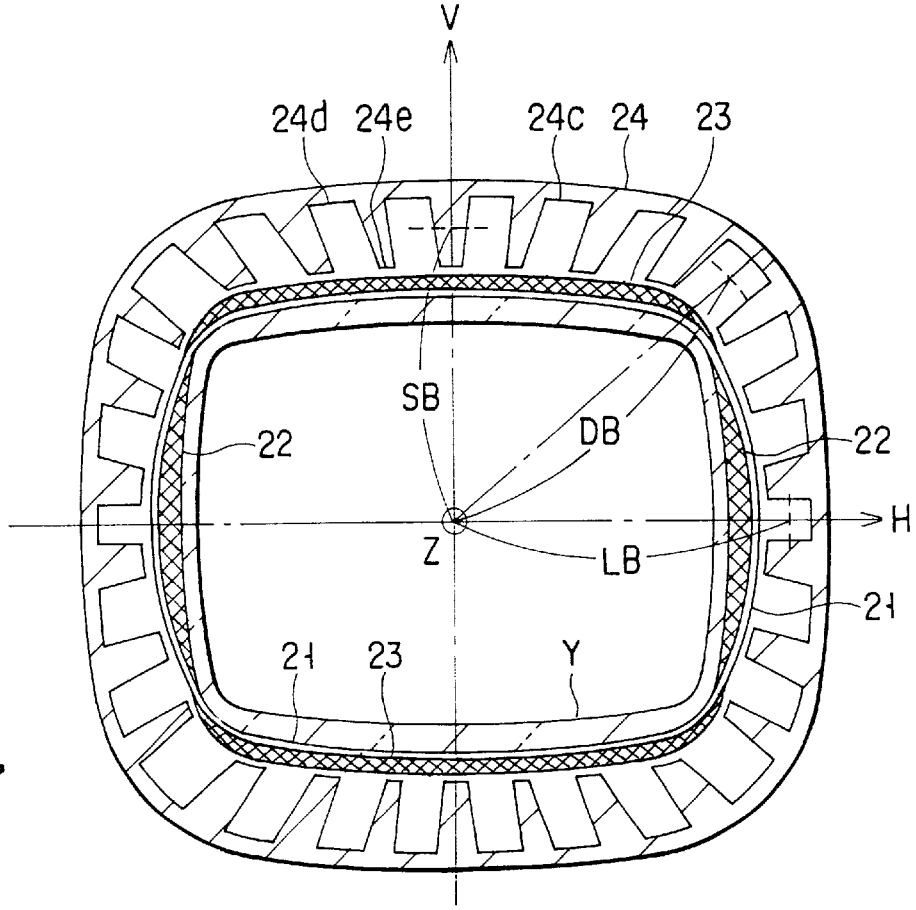
FIG. 7 is a sectional view of the yoke portion and the deflection yoke of the cathode ray tube apparatus of FIG. 1, taken in the direction perpendicular to the tube axis at a deflection reference point.

Specifically, as shown in FIG. 7, the horizontal deflection coil 22 is formed by winding a coil wire mainly on the neighborhood of the horizontal axis H in order to form a deflection magnetic field of pin-cushion type. The coil wire of the horizontal deflection coil 22 is wound in a smaller number of turns, the farther from the horizontal axis H. The sectional area of the coil wire constituting the vertical deflection coil 23 is distributed in such a manner as to be maximum in the neighborhood of the vertical axis V and to progressively decrease away from the vertical axis V in order to form a deflection magnetic field of barrel type.

Considering the sectional area of the coil wire and the reduction in the deflection power described above, it has been found effective to set the index X of the inner surface of the core portion 24 to about 0.90 or less. FIG. 7 shows a structure of a slot core with a slot 24*c* formed in the inner surface of the core portion 24. In the case where the core portion 24 has a structure as shown in FIG. 7, the inner diameter LB along the horizontal axis H, the inner diameter SB along the vertical axis V and the maximum internal diameter DB of the core portion 24 are assumed to be an average value of the diameter from the tube axis Z to the slot bottom 24*d* and the diameter from the tube axis Z to the slot top 24*e*.

Figure 8A:
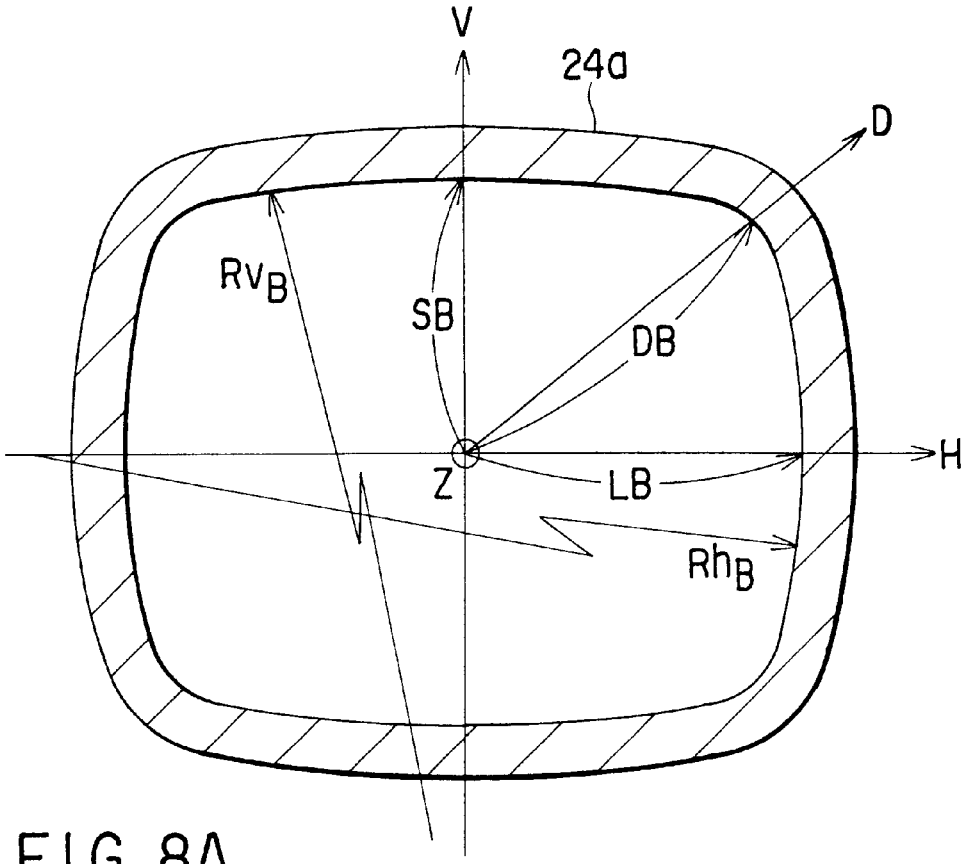
FIG. 8A is a diagram showing the shape of the end portion on the screen side of the core portion, perpendicular to the tube axis, of the deflection yoke shown in FIG. 7.
Figure 8B:
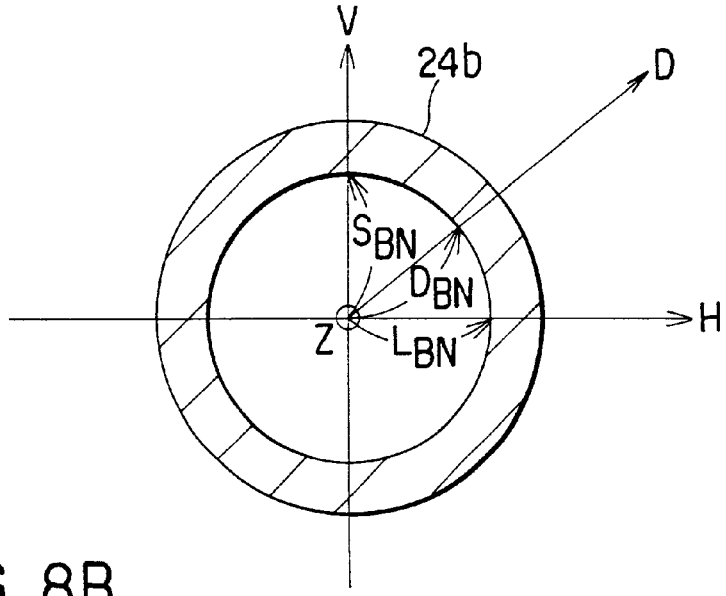
FIG. 8B is a diagram showing the shape of the end portion on the neck side of the core portion, perpendicular to the tube axis, of the deflection yoke.

FIGS. 8A and 8B show the shape of an end of the core portion 24 of the deflection yoke 20. The end portion 24*b* on the neck side of the core portion 24, as shown in FIG. 8B, is formed in a circle in a manner following the outer diameter of the neck portion. The section of the core portion 24 perpendicular to the tube axis Z between the end portion 24*b* and the boundary 14*b* is a circle of substantially the same shape as the outline of the neck portion. The inner diameter LB along the horizontal axis H and the inner diameter SB along the vertical axis V progressively decrease along the tube axis Z toward the screen away from the boundary 14*b*. As a result, the section perpendicular to the tube axis Z, of the core portion between the boundary 14*b* and the screen is a non-circle, that is, a rectangle having a maximum inner diameter DB larger than LB and SB.

The end portion 24*a* on the screen side of the core portion 24 is formed to have a rectangular inner profile in conformance with the outline of the pyramidal yoke portion, as shown in FIG. 8A. In the example shown in FIG. 8A, the aspect ratio of the inner profile substantially coincides with the aspect ratio of the screen and is M:N=4:3, for example.

Specifically, the outline of the section of the neck portion perpendicular to the tube axis Z is a circle. The outline of the section of the yoke portion perpendicular to the tube axis Z changes to a non-circle starting from the boundary 14*b* with the neck portion toward the faceplate. The deflection yoke mounted on the outer surface of the neck portion and the yoke portion having the above-mentioned outline has a core portion of a shape defined below. Specifically, at least a section of the core portion perpendicular to the tube axis Z, on the neck portion side of the boundary 14*b* between the neck portion and the yoke portion, is a circle similar to the outline of the neck portion. Also, at least a section of the core portion perpendicular to the tube axis Z, on the screen side of the boundary 14*b*, is a non-circle having a maximum inner diameter in a direction other than along the vertical axis and the horizontal axis. This section on the screen side of the boundary 14*b* is a rectangle in the case where the aspect ratio of the substantially rectangular phosphor screen is M:N. Assume that the aspect ratio of the inner diameters of the particular section of the core portion and the aspect ratio of the phosphor screen are substantially coincident with each other and hence that the aspect ratio of the inner diameters of the core portion is M:N. Also, let SB be the inner diameter of the core portion along the vertical axis, LB the inner diameter of the core portion along the horizontal axis and DB the maximum inner diameter of the core portion. Then, the section involved has a shape satisfying the relation $$(M+N)/2*(M2+N^2)^{1/2}<(SB+LB)/(2DB)\leqq 0.90$$

Also, at the end portion 24*b* on the neck portion side of the core portion, let SBN be the inner diameter of the core portion along the vertical axis, LBN the inner diameter along the horizontal axis and DBN the maximum inner diameter of the core portion. Then, the conditions shown below are desirably satisfied.

$$0.95\leqq SBN/DBN\leqq 1.05$$

$$0.95\leqq LBN/DBN\leqq 1.05$$

A preferred embodiment will be described below.

The basic structure is described above and will not be described in detail.

As shown in FIG. 1, the vacuum envelope 11 of the cathode ray tube apparatus 1 according to this embodiment comprises a glass faceplate P, a funnel portion F, a yoke section Y and a neck portion N. The central portion of the effective surface 12 of the faceplate P is 10 to 14 mm thick. The yoke portion Y is 2 to 8 mm thick, and is formed in the shape of a pyramid in which the portion thereof in the neighborhood of the diagonals is thin and the portions thereof in the neighborhood of the horizontal and vertical axes are thick.

As shown in FIG. 3, the deflection yoke 20 is mounted on the yoke portion Y in such a position that the end portion 20*a* on the screen side thereof is located in the neighborhood of the boundary 14*a*. This deflection yoke 20 includes a horizontal deflection coil 22 and a vertical deflection coil 23 insulated from each other by a horn-type separator 21. These deflection coils are of saddle type and constitute what are called the saddle-saddle type deflection coils. Specifically, the horizontal deflection coil 23 is fixed in grooves formed in the inner wall of the separator 21. The vertical deflection coil 23 is fixed on the outer wall of the separator 21. The cylindrical core portion 24 formed of a magnetic material of a high permeability is fixed around the outer periphery of the vertical deflection coil 23.

The core portion 24 has an inner surface similarly shaped to the outline of the pyramidal yoke portion 14. The inner profile of the section of this core portion 24 is a substantial circle at the end portion 24*b* on the neck portion side thereof, as shown in FIG. 8B, and a non-circle, that is, a substantial rectangle at the end portion 24*a* on the screen side, as shown in FIG. 8A. The section of the core portion 24 perpendicular to the tube axis Z changes from a circle to a non-circle progressively from the end portion 24*b* on the neck portion side thereof toward the end portion 24*a* on the screen side thereof, and assumes a maximum diameter at the end portion 24*a* on the screen side thereof.

Figure 9:
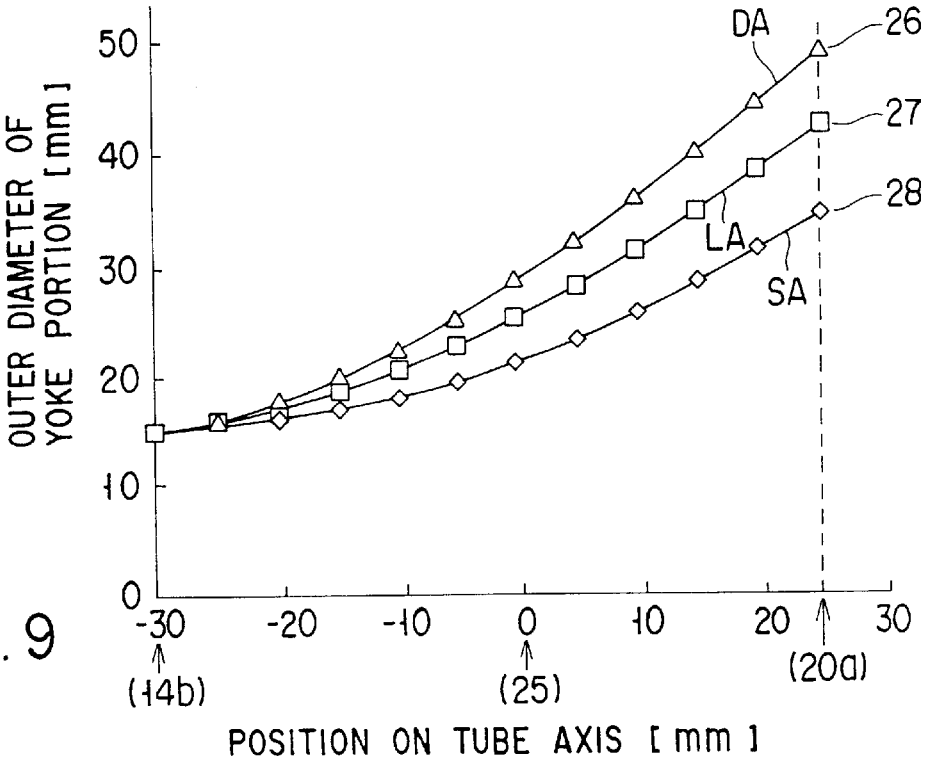
FIG. 9 is a diagram showing the relation between position of the yoke portion of the cathode ray tube apparatus along the tube axis and the maximum outer diameter, the outer diameter along the horizontal axis and the outer diameter along the vertical axis of the yoke portion according to an embodiment of the invention.

More specifically, the yoke section Y has a vertical section having the dimensions as shown in FIG. 9 at a position on the tube axis Z. In FIG. 9, the abscissa represents the position on the tube axis Z from the boundary 14b between the neck portion N and the yoke portion Y to the end portion 20*a* of the deflection yoke 20. In this case, it is assumed that the deflection reference point 25 is 0, the screen side is positive and that the neck side negative. A curve 26 represents the outer diameter DA along the diagonal axis, a curve 27 the outer diameter LA along the horizontal axis, and a curve 28 the outer diameter SA along the vertical axis.

As shown by these curves 26 to 28, the outer diameters DA, LA and SA along the diagonal axis, the horizontal axis and the vertical axis, respectively, are equal to each other in the neighborhood of the boundary 14*b*. The outer diameters LA and SA along the horizontal axis and the vertical axis, respectively, decrease relative to the outer diameter DA progressively toward the screen. Specifically the sectional shape of the yoke portion Y in the neighborhood of the boundary 14*b* is a circle of substantially the same diameter as the neck portion N. Also, the sectional shape of the yoke portion Y on the screen side thereof is a substantial rectangle having the maximum diameter along the diagonals.

In this case, the aspect ratio M:N of the phosphor screen 17 is 4:3. Further, the sectional shape of the yoke portion Y at the deflection reference point 25 is given as $$(LA+SA)/(2DA)=0.83$$

where DA=30.2 mm, LA=27.5 mm and SA=22.5 mm. Also, the radii of curvature of the section of the yoke portion Y at the deflection reference point 25 are $$Rh=113\text{ mm},\ Rv=312\text{ mm},\ \text{and}\ Rd=8.8\text{ mm}$$

Under this condition, the maximum vacuum stress of the yoke portion Y is 8.07 Hpa, which is a sufficient value as the bulb strength of a vacuum envelope.

Also, the section at the end portion 24*a* on the screen side of the core portion 24 of the deflection yoke 20 is given as $$(LB+SB)/(2DB)=0.88$$

where DB=48.2 mm, LB=44.7 mm and SB=39.8 mm.

With a cathode ray tube apparatus having this structure, the deflection power could be reduced by about 18% as compared with the cathode ray tube apparatus having a conical yoke portion. Once the deflection power is reduced in this way, the leakage magnetic field can also be reduced.

Further, the section of the end portion 24*b* on the neck portion side of the core portion 24 of the deflection yoke 20 has an inner surface profile in the shape of a substantial circle. The inner diameter, that is, the distance from the tube axis to the inner surface is 45 mm. In this case, the circle may be deformed in a manner conforming to end of the shape of the horizontal deflection coil, the vertical deflection coil or the shape of the separator. In reducing the deflection power, however, the degree of deformation is preferably held within ±5% as a measure along the horizontal axis or the vertical axis.

The foregoing is the description of the saddle-saddle type deflection yoke according to an embodiment of the invention. This embodiment is also applicable to a cathode ray tube apparatus comprising a saddle-toroidal type deflection yoke. In the latter case, the core portion uses a core with a toroidal coil.

Industrial Applicability

It will thus be understood from the foregoing description that according to the present invention there is provided a cathode ray tube apparatus in which the requirements for a high brightness and a high frequency deflection can be met by employing a deflection yoke suitable for a vacuum envelope having a sufficient bulb strength and having a yoke portion with an outline capable of effectively reducing the deflection power.

What is claimed is:

1. A cathode ray tube apparatus comprising:

a vacuum envelope including a faceplate having on the inner surface thereof a substantially rectangular phosphor screen having an aspect ratio M:N between the length along a horizontal axis perpendicular to a tube axis and the length along a vertical axis perpendicular to the tube axis and the horizontal axis; a cylindrical neck portion having an electron gun assembly built therein for emitting electron beams in the direction along the tube axis, a funnel portion for connecting said faceplate and said neck portion, and a yoke portion of which a section perpendicular to the tube axis on the neck portion side of the funnel portion changes in shape from a circle of the same diameter as the neck portion to a non-circle having a maximum diameter in other than the directions along the horizontal axis and the vertical axis; and a deflection yoke mounted on the outer surface of the vacuum envelope and extending from said neck portion to the yoke portion for forming a deflection magnetic field for deflecting the electron beams;

wherein said deflection yoke includes a cylindrical core formed of a magnetic material surrounding at least one of a horizontal deflection coil and a vertical deflection coil for forming said deflection magnetic field; and wherein at least one section of said core portion perpendicular to said tube axis is a non-circle having a maximum inner diameter in other than the direction along the vertical axis and the horizontal axis, where the inner diameter is the distance between the tube axis and the inner surface of the core portion, and holds the relation $$(M+N)/(2*(M^2+N^2)^{1/2}<(SB+LB)/(2DB)\leqq 0.90$$

where SB is the inner diameter along the vertical axis, LB the inner diameter along the horizontal axis, and DB the maximum inner diameter.

2. A cathode ray tube apparatus according to claim 1, wherein said section is located nearer to the phosphor screen from a deflection reference point on the tube axis, where said deflection reference point is a point on the tube axis when the angle between said tube axis and a straight line connecting a diagonal end of the phosphor screen and said point on the tube axis is one half the maximum deflection angle of the cathode ray tube apparatus.

3. A cathode ray tube apparatus according to claim 2, wherein said section of said yoke portion perpendicular to the tube axis at said deflection reference point is a non-circle having a maximum outer diameter in a direction other than along said vertical axis and said horizontal axis, where the outer diameter is the distance between said tube axis and the outer surface of said yoke portion, and holds the relation $$(M+N)/(2*(M^2+N^2)^{1/2})<(SA+LA)/(2DA)\leqq 0.86$$

where SA is the outer diameter along the vertical axis, LA the outer diameter along the horizontal axis, and DA the maximum inner diameter.

4. A cathode ray tube apparatus according to claim 1, wherein at least one of the sections of said core portion perpendicular to said tube axis at the neck-side end portion thereof holds the relations $$0.95\leqq SBN/DBN\leqq 1.05$$

$$0.95\leqq LBN/DBN\leqq 1.05$$

where SBN is the inner diameter along the vertical axis, LBN the inner diameter along the horizontal axis and DBN the maximum inner diameter.

5. A cathode ray tube apparatus according to claim 4, wherein LBN=SBN=DBN.

6. A cathode ray tube apparatus according to claim 1, wherein in the case where the outline of said faceplate is approximated to a circle, the radius of curvature thereof is at least twice the effective diagonal length of said phosphor screen.

* * * * *

UNITED STATES PATENT AND TRADEMARK OFFICE

CERTIFICATE OF CORRECTION

PATENT NO. : 6,404,117 B1 
DATED : June 11, 2002
INVENTOR(S) : Soneda, Kouichi, Sano, Yuuichi and Yokota, Masahiro It is certified that error appears in the above-identified patent and that said Letters Patent is hereby corrected as shown below:

Title page,
Item [86], (2), (4) Date, please change "Nov. 6, 1999" to -- Nov. 16, 1999 --.

Signed and Sealed this

Twenty-ninth Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,404,117 B1 
DATED : June 11, 2002
INVENTOR(S) : Soneda, Kouichi, Sano, Yuuichi, and Yokota, Masahiro It is certified that error appears in the above-identified patent and that said Letters Patent is hereby corrected as shown below:

Title page,
Item [73], Assignee, please change "Kenagawa-Ken (JP)" to -- Kawasaki-shi (JP) --.

Item [86], (2), (4) Date, please change "Nov. 6, 1999" to -- Nov. 16, 1999 --.

Signed and Sealed this

Fourth Day of November, 2003

JAMES E. ROGAN
*Director of the United States Patent and Trademark Office*